US009308971B2

(12) United States Patent
Isbill

(10) Patent No.: US 9,308,971 B2
(45) Date of Patent: Apr. 12, 2016

(54) DAVIT CRADLE LIFT FOR SMALL BOATS

(71) Applicant: Otto L. Isbill, St. Clair Shores, MI (US)

(72) Inventor: Otto L. Isbill, St. Clair Shores, MI (US)

( * ) Notice: Subject to any disclaimer, the term of this patent is extended or adjusted under 35 U.S.C. 154(b) by 0 days.

(21) Appl. No.: 14/665,719

(22) Filed: Mar. 23, 2015

(65) Prior Publication Data

US 2015/0266550 A1 Sep. 24, 2015

Related U.S. Application Data

(60) Provisional application No. 61/969,500, filed on Mar. 24, 2014.

(51) Int. Cl.
*B63B 23/02* (2006.01)
*B63B 23/32* (2006.01)
*B63B 23/44* (2006.01)

(52) U.S. Cl.
CPC ..... *B63B 23/02* (2013.01); *B63B 23/32* (2013.01); *B63B 23/44* (2013.01)

(58) Field of Classification Search
CPC ..... B63B 23/00; B63B 23/32; B63B 27/36; B63B 23/42; B63B 23/34; B63B 23/02; B63B 23/06; B63B 35/40
USPC ..... 114/365, 366, 368, 369, 373
See application file for complete search history.

(56) References Cited

U.S. PATENT DOCUMENTS

| | | | | |
|---|---|---|---|---|
| 3,143,991 | A * | 8/1964 | Anderson | B63B 23/18 114/365 |
| 4,864,951 | A * | 9/1989 | Koepp, Jr. | B63B 23/32 114/366 |
| 4,964,358 | A * | 10/1990 | Sandrow | B63B 23/32 114/365 |
| 5,133,275 | A * | 7/1992 | Maurizio | B63B 23/32 114/259 |
| 6,038,994 | A * | 3/2000 | Ford | B63B 23/32 114/259 |
| 6,474,256 | B1 | 11/2002 | Vogel | |
| 8,256,366 | B2 | 9/2012 | Imel et al. | |
| 8,631,752 | B2 | 1/2014 | Hauersperger | |
| 2001/0032579 | A1 | 10/2001 | Holcomb et al. | |
| 2003/0192466 | A1 | 10/2003 | Trowbridge | |
| 2004/0099198 | A1 | 5/2004 | Blackmore | |
| 2008/0105186 | A1 | 5/2008 | Johns, Jr. et al. | |

* cited by examiner

*Primary Examiner* — Lars A Olson
(74) *Attorney, Agent, or Firm* — Young Basile Hanlon & MacFarlane P.C.

(57) ABSTRACT

A davit lift for small boats can be pivotally coupled to a rearwardly projecting horizontal surface of a boat. The davit lift includes a cradle formed of multiple tubular members arranged to support a small boat. Apertures formed in one end of the tubular members are alignable with apertures in a pair of mounting brackets affixable to a boat to receive lock pins. Selective engagement and disengagement of the lock pins allows the cradle to be pivoted from its deployed position, an upright storage position and a forward inclined transport position.

13 Claims, 11 Drawing Sheets

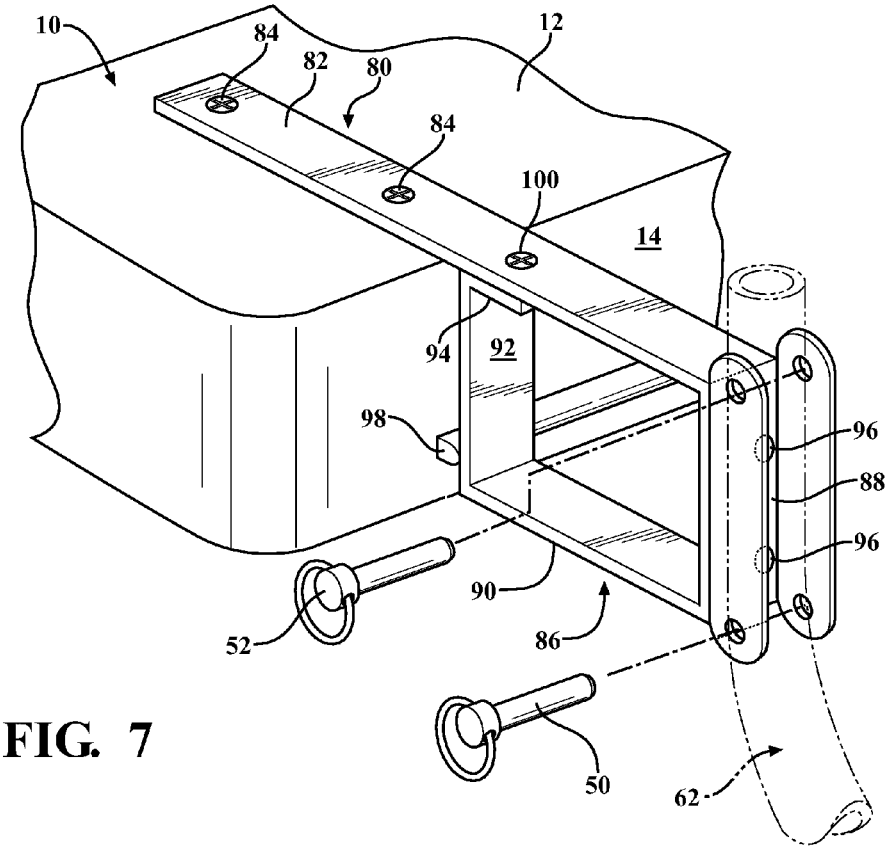
FIG. 7
FIG. 8
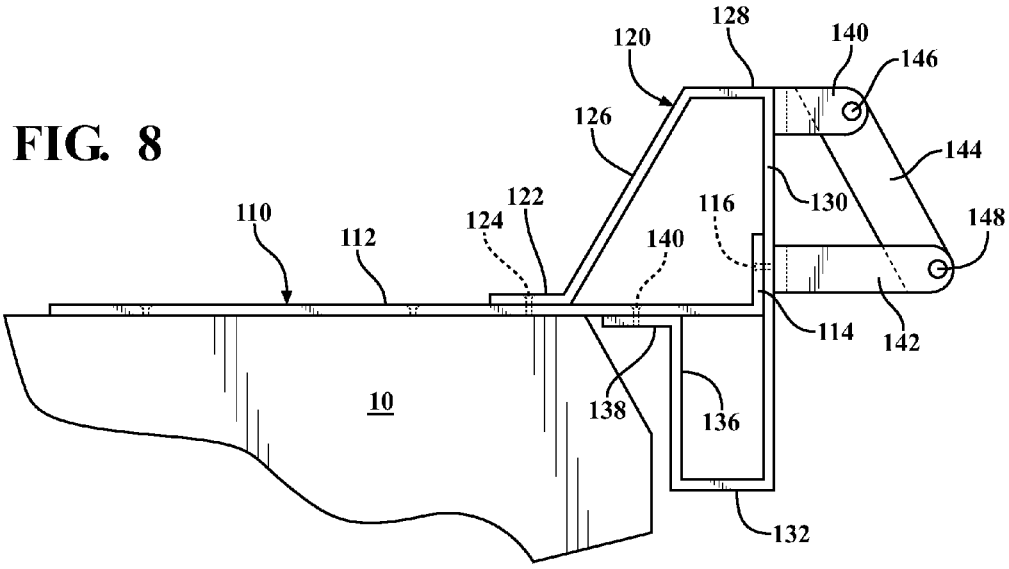

DAVIT CRADLE LIFT FOR SMALL BOATS

CROSS-REFERENCE TO CO-PENDING APPLICATION

This application claims priority benefit to the Mar. 24, 2014 filing date of U.S. Provisional Patent Application Ser. No. 61/969,500, filed in the name of Otto L. Isbill, for a Davit Cradle Lift For Small Boats, the entire contents of which are incorporated herein in its entirety.

BACKGROUND

There are examples of lift devices attachable to the transom and/or the swing platform of large boats to launch or lift and carry the small boats next to the transom of the larger boats.

Such lift devices include arms or cradles mounted to a rear surface or platform of a boat. Some cradles are hinged to permit the cradles to be rotated upwardly sometimes more than 90°, to raise a small boat mounted in the cradle up and out of the water for easy transport with a larger boat.

However, such previous small boat lifts are cumbersome, large or difficult to use and may render the rear portion or swim platform of the larger boat somewhat unusable for its intended purpose.

SUMMARY

A davit cradle lift for boats with a rearwardly projecting horizontal surface. The davit cradle lift includes a cradle formed of two spaced longitudinally extending members, each having first and second opposed ends, and a third laterally extending member connected adjacent the second ends of the first and second longitudinally extending members. Two spaced apertures formed in an arcuate section extending from a linear end portion of the first ends of each of the first and second tubular members. A pair of mounting brackets is affixable to a horizontal rearward extending surface of a boat. The mounting brackets carrying first and second pairs of spaced apertures. First and second pins are respectively mountable in an upper most pair and a lower most pair of the aligned aperture pairs in the first and second mounting brackets. The first and second pins extend through one aperture of the aperture pairs in the first end portion of each of the first and second tubular members. The first and second pins are removable and insertable both at the same time, or only the second pin, or only the upper pin, to allow the cradle to move between a lowered position where the cradle is disposed in the water to launch or retrieve a dinghy, and at least a first generally vertically extending upright storage position.

To achieve the boat launch and retrieval position, the pin is removed from the apertures in the mounting bracket and the first ends of the longitudinally extending first and second tubular members of the cradle.

The first storage position is secured by inserting both of the first and second pins into the aligned pairs of apertures in the mounting bracket and the apertures in the first ends of the first and second tubular members of the cradle after the cradle has been pivoted to a generally upright portion.

The forward angled storage position is achieved by removing the second pin from the aligned apertures in the mounting bracket and the first and second longitudinally extending members of the cradle to allow the cradle to pivot about the first pin in the pair of apertures in the mounting brackets and one aperture in the first end of the first and second longitudinally extending members to a forward inclined position.

The pair of mounting brackets can include a first leg portion mountable to a boat surface, and a vertically extending portion. Upper and lower pairs of arms are fixedly coupled to a vertical portion of each mounting bracket. Apertures are formed in the pairs of arms for receiving the pins.

A stop member may be mounted on the vertical portion of the mounting brackets, to provide a reference surface for aligning the apertures in the longitudinally extending members of the cradle of the apertures in the arms.

In another aspect, each mounting bracket includes the first leg portion defining a linear leg portion; the vertical portion extending from one end of the first leg portion; and an angled section extending from an end of the vertical portion to a fixed connection with the first leg portion.

A fourth laterally extending member may be provided adjacent the first ends of the first and second longitudinally extending members.

The davit lift can further include each of the longitudinally extending tubular members having a first leg portion extending from a curved portion adjacent the first end and extending toward the opposite longitudinally extending member. A second leg portion extends from the second end of each longitudinally extending tubular member, the second end portions having opposed ends facing the opposite tubular member. Connectors fixedly couple ends of the first and second leg portions of each of the longitudinally extending members into a unitary configuration.

BRIEF DESCRIPTION OF THE DRAWING

The various features, advantages and other uses of the present davit cradle lift for small boats will become more apparent by referring to the following detailed description and drawing in which:

FIG. 7 is a exploded, perspective view showing one of the mounts to the davit cradle lift depicted in FIG. 6;

FIG. 8 is a side elevational view showing another aspect of a davit cradle lift;

DETAILED DESCRIPTION

Figure 1:
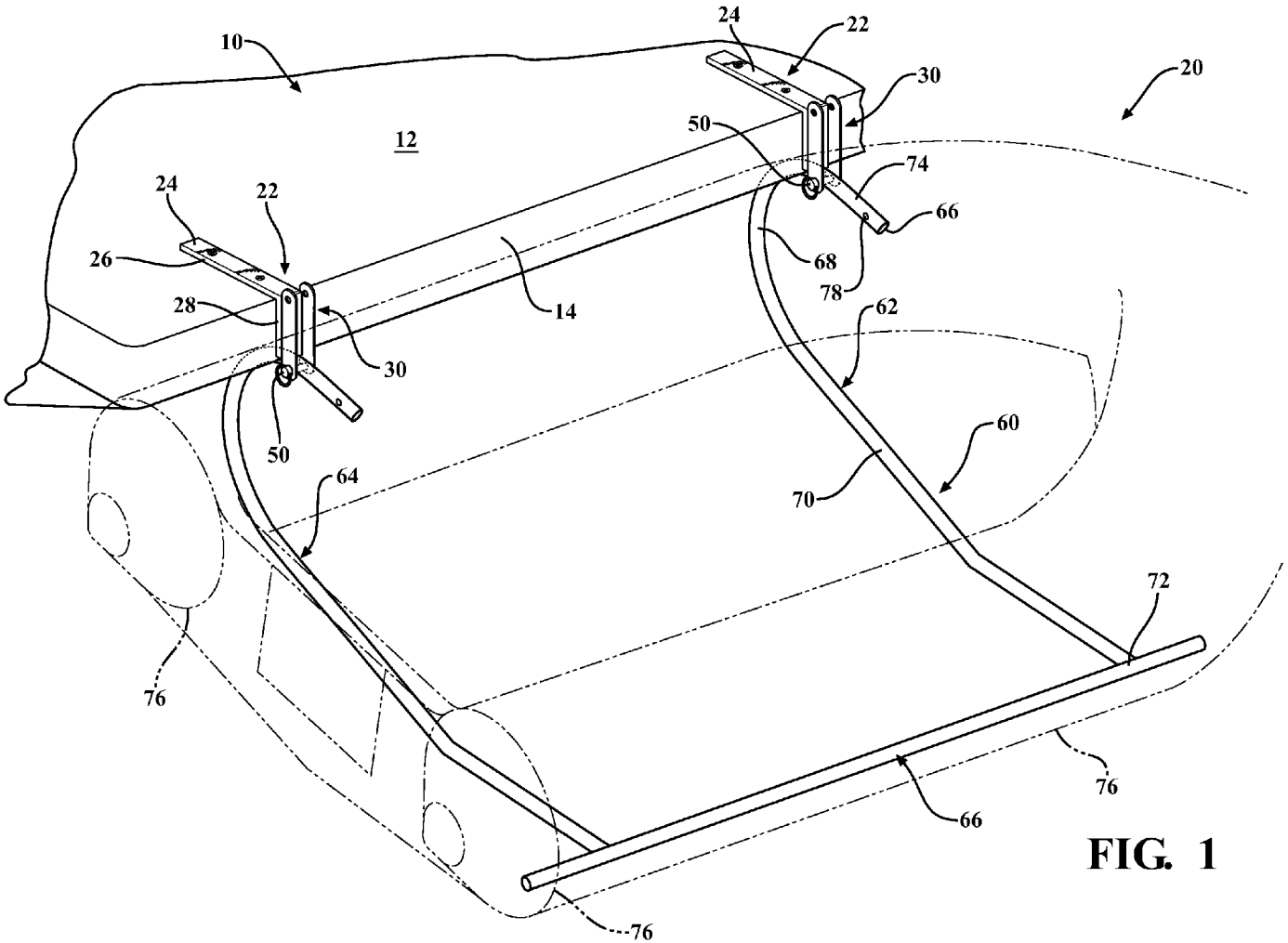
FIG. 1 is a perspective view of a davit cradle lift for small boats shown in a downward deployed position for loading and unloading a small boat from the cradle lift.

FIG. 1 depicts a swim platform 10 in the form of a generally horizontally extending ledge located adjacent to a transom of a boat. The swim platform 10 has a horizontally extending surface 12 and a vertically extending outer ledge 14.

A davit cradle lift 20 is positioned rearward of the swim platform 12. The davit lift 20 includes a mounting assembly 22 formed of two pairs of brackets 24, show in FIGS. 1-5. Each bracket 24 has first and second perpendicularly oriented legs 26 and 28. The first and second legs 26 and 28 are fixed to the swim platform 12 by fastening means, such as fasteners in the form of screws, bolts, etc. Although the legs 26 and 28 of the bracket 24 are shown laying over the horizontal surface 12 and the vertical surface 14 of the swim platform 10, it is possible to form the first bracket 24 with just a single leg portion 28 fixed to the vertical extending portion of the swim platform 10.

Figure 2A:
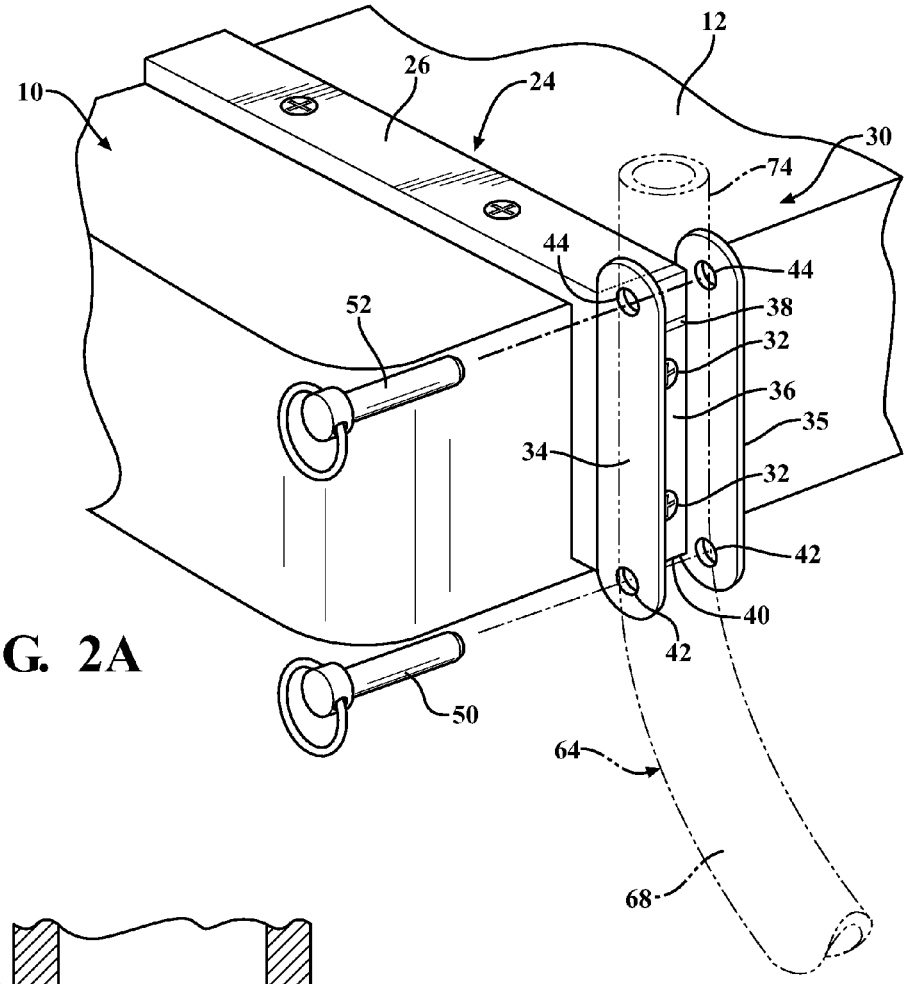
FIG. 2A is an enlarged perspective view showing one mount of the cradle lift of FIG. 1 on a swim platform of a boat.

A second bracket 30 is fixed to the vertically extending second leg 28 of the first bracket 24 by suitable fasteners 32, shown in detail in FIG. 2, which extend through aligned apertures in the second bracket 30 and the second leg 28 of the first bracket 24 into vertically extending surface 14 of the swim platform 10.

The second bracket 30 has a general U-shaped formed of first and second spaced walls 34 and 35, which are joined along an intermediate portion by a central wall 36 carrying the apertures for the fasteners 32 used to join the second bracket 30 to the first bracket 24 and/or to the vertical surface 14 of the swim platform 10.

By way of example, the central wall 36 has first and second ends 38 and 40 which terminate short of the outermost ends of the walls 34 and 35. An aligned pair of apertures 42 is formed in one end of the walls 34 and 35. The second pair of apertures 44 are formed in the opposed ends of the walls 34 and 35. The first pair of lower located apertures 42 are disposed below the upper located second pair of apertures 44. The pair of apertures 42 and 44 receive a removable lock pins, such as a first pin 50, removably mountable through the pair of aligned apertures 42, and a second pin 52 removably mountable through the other pair of aligned apertures 44.

The davit lift 20 includes a cradle assembly 60. The cradle assembly 60 is formed of joined tubular members including first and second longitudinal tubular members 62 and 64 and a third laterally extending tubular member 66 fixed to the end of the first and second tubular members 62 and 64.

The tubular members 62, 64, and 66 are formed of a suitable corrosion resistant material, such as aluminum or stainless steel. Aluminum is ideal for use in fresh water; while stainless steel is ideal for use in saltwater.

The first and second tubular members 62 and 64 have substantially identical shapes formed of a first end 66, a curved end portion 68, and a generally shallow V-shaped portion 70 which extends to a second end 72. The V-shape portion 10 of the tubular member 62 or 64 is by example as the portion 70 may alternately have a generally linear shape. The V-shape is suitable for use with small boats, such as inflatable dinghy which have a rigid V-shaped hull.

The curved portion 68 of the first tubular member 62 or the second tubular member 64 extends from a generally linear end portion 74 extending from the first end 66 through an approximate 180° bend to the start of the longitudinal portion 70.

The linear end portion 74 of each of the first and second tubular members 62 and 64 includes first and second spaced apertures 76 and 78. The apertures 76 and 78 are spaced apart the same distance as the spacing between the apertures 42 and 44 in the walls 34 and 35 of the second bracket 30.

Figure 2B:
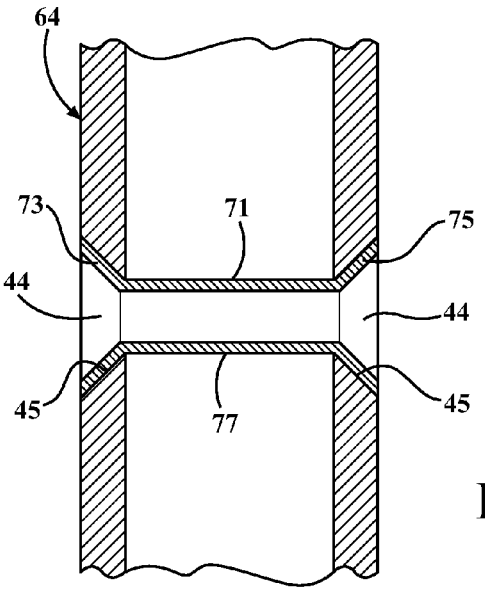
FIG. 2B is an enlarged cross-sectional view showing the pin entry apertures in the tubing.

The outer ends of the apertures 76 and 78 are flared, ad shown in FIG. 2B. A tubular sleeve 71 as having a first flared end 73 and then opposed flared end 75 disposed on opposite ends of a tubular portion 77. The sleeve 71 is initially provided with one flared end, such as flared end 73 prior to insertion of the tubular portion 77 through one aperture 44 and the tubular member 64 until the opposite end of the tubular portion 77 is disposed within the opposed aperture 44 in the tubular member 64. The end of the tubular portion 77 is then bent outward into the flare 75 shown in FIG. 2B. The tubular sleeve 71 provides for ease of inserting the lock pins 50 and 52 through the apertures 76 and 78 in each tubular member 62 and 64.

The third tubular member 66 extends laterally between the spaced tubular members 62 and 64 and is fixed to the second ends 72 of the first tubular members 62 and 64 to complete the cradle 20. The third tubular member 66 is spaced from the inner surfaces of the curved end portion 68 of the first and second tubular members 62 and 64 by a distance suitable for slidably receiving the inflatable pontoons 76 of a small dinghy.

It should be noted that the radius of the curved end portion 68 at the first end of the tubular members 62 and 64 is sized to receive one inflatable pontoon 76 of a dinghy.

Figure 3:
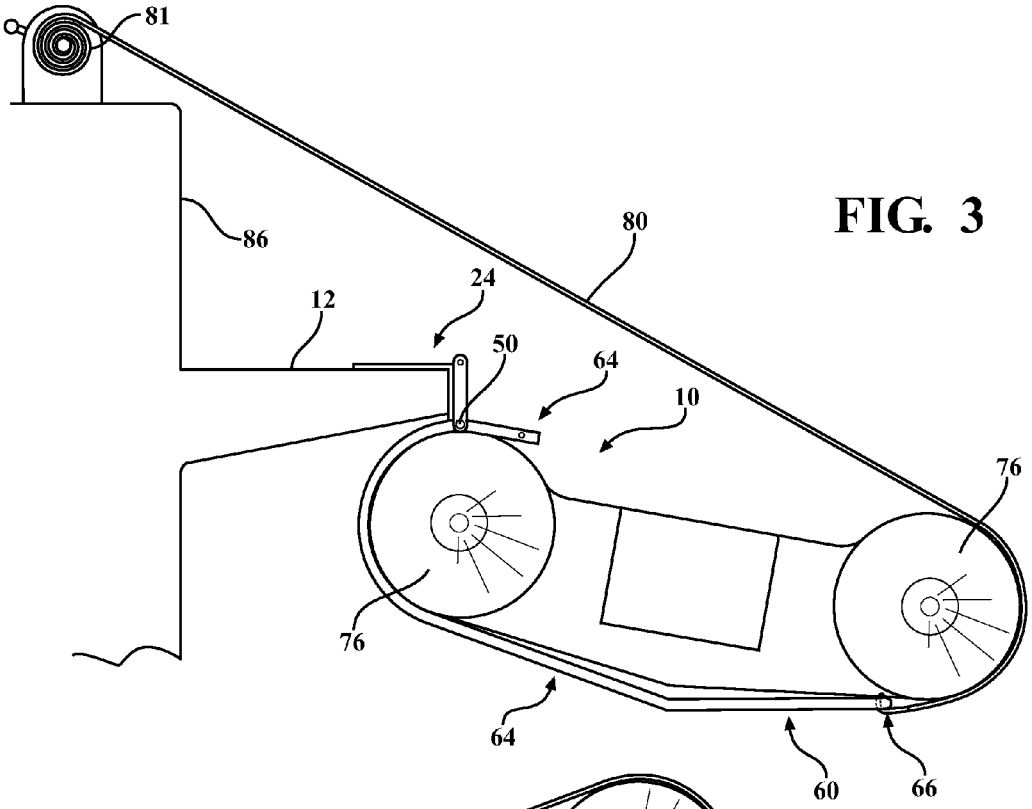
FIG. 3 is a side elevational view of the davit cradle lift shown in a deployed position of FIG. 1.
Figure 4:
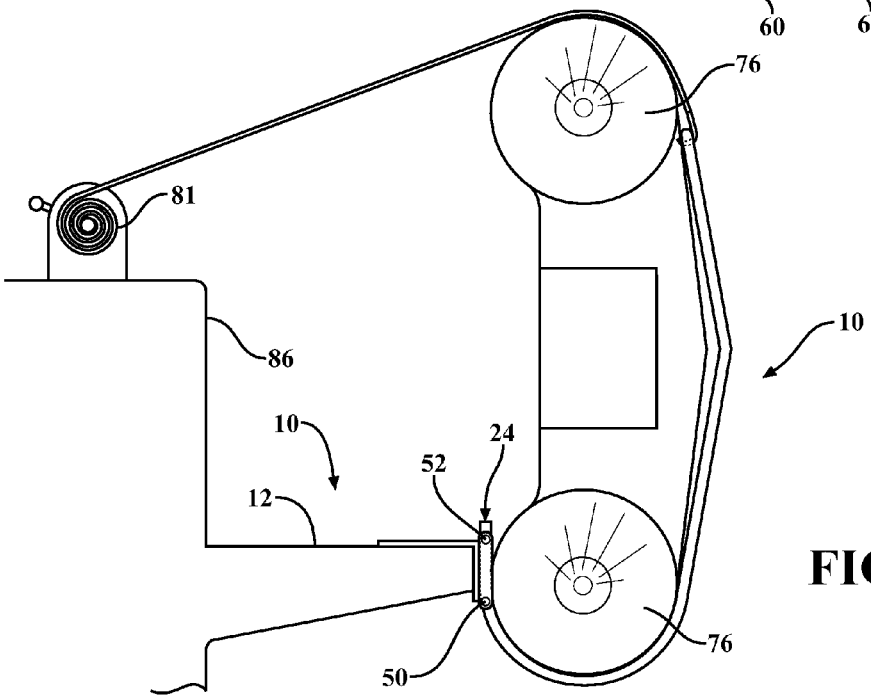
FIG. 4 is a side elevational view showing the davit cradle lift of FIGS. 1-3 depicted in a raised, substantially vertical storage position.
Figure 5:
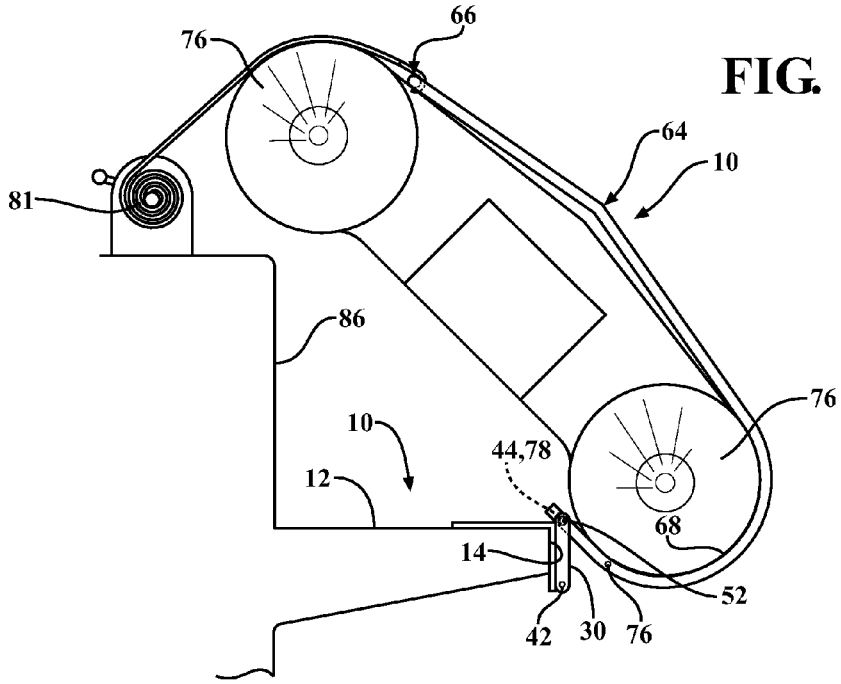
FIG. 5 is a side elevational view showing the davit cradle lift of FIGS. 1-4 in a forward inclined, transport position.

The removable lock pins 50 and 52 in combination with the second mounting brackets 30 and the apertures 76 and 78 in the curved end portion 68 of the first and second tubular members 62 and 64 enables a dinghy to be launched and retrieved from the cradle position shown in the FIGS. 1 and 3, stored in a generally vertically extending upright position shown in FIG. 4 where the entire horizontal surface 12 of the swim platform 10 is still accessible for use, to a forward angular extending storage position shown in FIG. 5 typically for use during periods of movement of the large boat.

FIGS. 2 and 4 show the lock pins 50 and 52 inserted through the respective pairs of apertures 42 and 44 in the second mounting bracket 30 and the apertures 76 and 78 in the first end 74 of each of the first and second tubular members 62 and 64. This supports the davit lift 20 and the dinghy mounted therein in a generally vertical extending storage position.

In this vertically extending position, the davit lift 20 enables the horizontal surface 12 of this the swim platform 10 to be freely accessible.

Removal of the uppermost or second lock pin 52 enables the cradle 60 to be pivoted about the lower lock pin 50 to a lowered dinghy launch and retrieval position shown in FIGS. 1 and 3. In this position, the cradle 60 rest in the water to enable to dinghy is pushed out of the cradle 60 for launching or moved into the cradle for retrieval.

In the dinghy retrieval position shown in FIG. 3, a strap 80 attached to winch generally shown by reference number 81 affixedly mounted on the large boat, such as on a transom, a transom rail, or other convenient mounting position, is secured at an outer end to the third laterally extending tubular member or tie bar 66. The winch 81 enables the entire cradle 60 to be pivoted and raised about the pivot axis formed by the pivot pin 50, the aligned apertures 42 and mounting bracket 30 and the first aperture 76 in each of the tubular members 62 and 64. A reverse winch operation lowers the cradle 60 carrying the dinghy to the launch position shown in FIGS. 1 and 3.

With the dinghy positioned in the cradle 60 as shown in FIGS. 1 and 3, the winch 81 may be rotated to pull in the strap 80 thereby pivoting the cradle 60 about the pivot axis of the lower pins 50 to a first, generally vertically extending storage position shown in FIG. 4.

In this position, the second apertures 78 in the tubular members 62 and 64 fit between the walls 34 and 35 of the second mounting bracket 70 in a line with the pair of apertures 44 in the walls 34 and 35 of the second mounting bracket 30. The upper lock pin 52 may then be inserted into the aligned apertures 44 and 76 to lock the cradle 10 in the first vertically extending storage position shown in FIG. 4.

For extended travel of the large boat, the winch 81 may be rotated to further pull the strap 80 toward the boat transom as noted by reference 86 in FIG. 5 after the lower lock pin 50 has been removed from the aligned apertures 42 and 76. This allows the curved end portion 68 of the tubular members 62 and 64 to pivot about a pivot axis formed by the upper lock pin 52 mounted in the aligned apertures 44 and 78 to enable the entire cradle 10 to pivot from the generally 90° storage position shown in FIG. 4 approximately 45° forward toward the boat transom 86. This lowers the uppermost edge of the dingy for more aero dynamic movement of large boat through the water.

Referring now the FIGS. 6 and 7, there is depicted a modification to the first bracket now illustrated by reference number 80. The first bracket 80 is formed of a suitable corrosion resistant material, such as aluminum for freshwater use and stainless steel for saltwater use. The first mounting bracket 80 includes an elongated first leg 82 adapted to overlay the top or horizontal surface 12 of the swim platform 10. One or more apertures 84 are formed in the first leg 82 for receiving fasteners to secure the first leg 82 of the first bracket 80 to the horizontal surface 12 of the swim platform 10.

The first bracket 80 also includes a rigid frame structure 86, which can be integrally formed with the first leg 82 and which includes a plurality of generally linear legs including a second leg 88, a third leg 90 disposed generally parallel to the first leg 82, a fourth leg 92 and a fifth leg 94. It will be understood that the frame structure 86 may also have other shapes, including any polygonal shape, such as square, rectangular, triangular etc., as well as a smoothly curved constant radius, circular shape.

The second leg 88 depends from one end of the first leg 82 and is generally spaced a predetermined distance from the vertical surface 14 of the swim platform 10 to allow sufficient room beneath the first mounting bracket 80 for pivotal movement of the tubular members 62 or 64, as described above. One or more apertures 96 are formed in the second leg 88 for receiving fasteners to secure the second bracket 70 to the second leg 88 of the first bracket 80 in the same manner as shown in FIG. 1.

Figure 6:
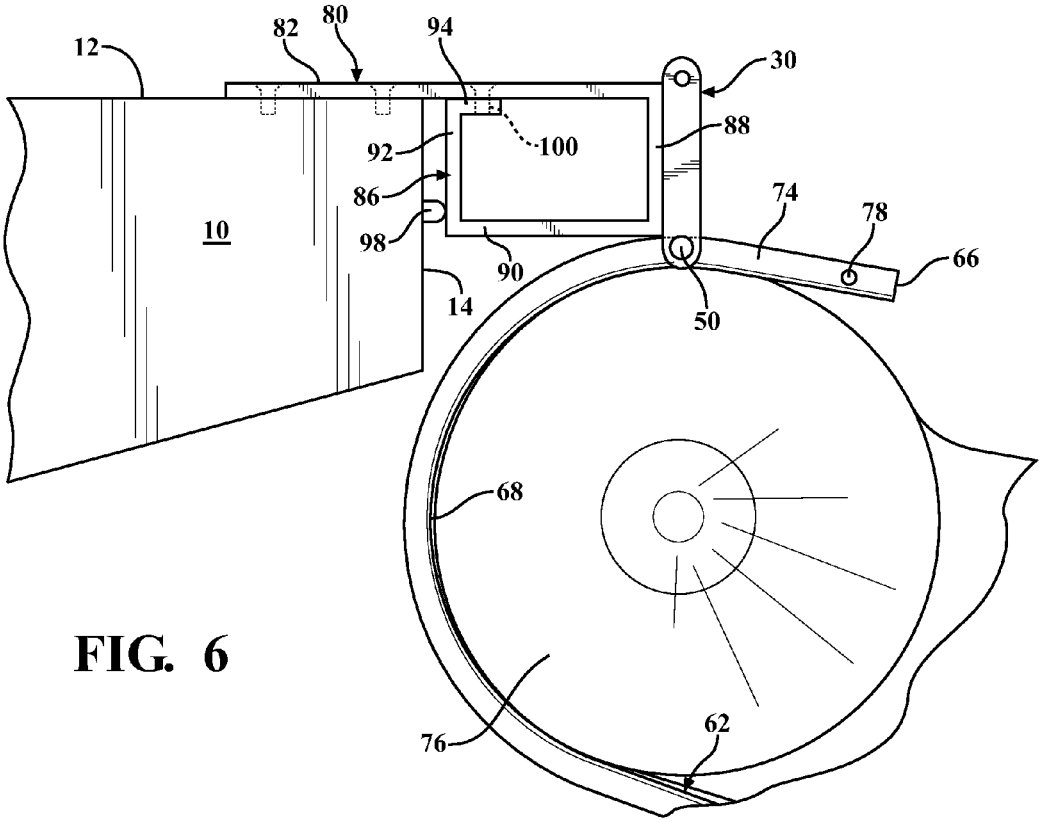
FIG. 6 is a side elevational view of another aspect of a davit cradle lift.
Figure 9:
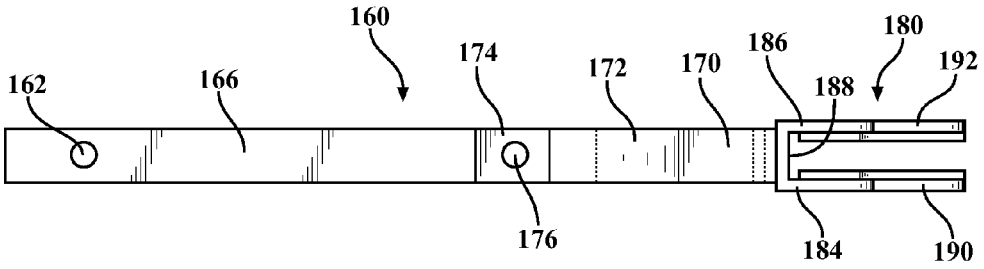
FIG. 9 is a plan view of another aspect of a mount for a davit cradle lift.
Figure 11:
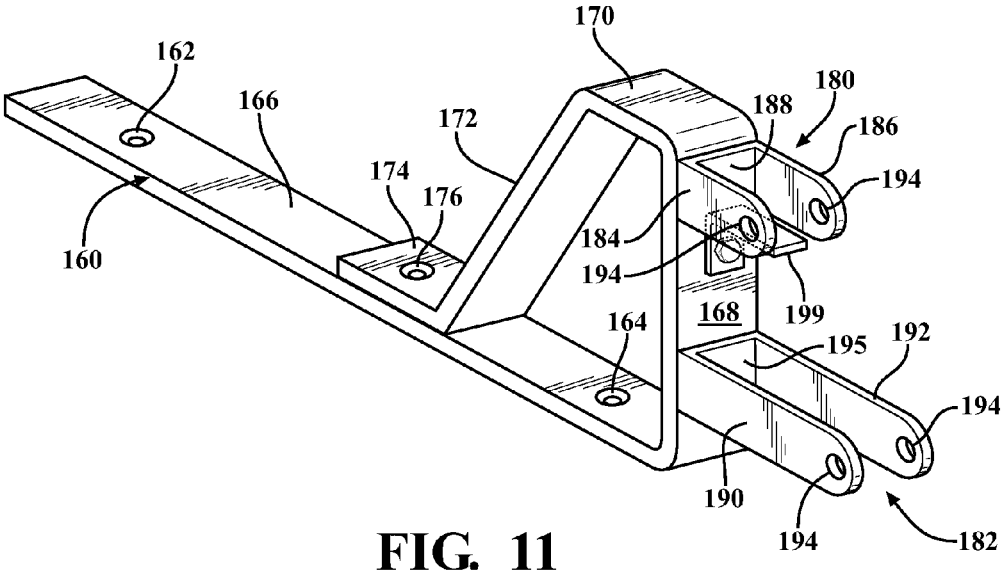
FIG. 11 is a perspective view of one of the mounts shown in FIGS. 9 and 10.

As shown in FIGS. 6 and 7, the fourth leg 92 slightly spaced apart or in contact with the vertical surface 14 of the swim platform 10. By example, a fourth leg 92 may abut a rub rail 98 extending laterally across the vertical surface 14 of the swim platform 10.

A fifth leg 100 is disposed adjacent to the first leg 82 and secured to the first leg 82 by suitable means, such as fasteners, including screws, or welding, adhesive, etc.

Referring now to FIG. 8, there is depicted another aspect of a mounting bracket for the davit cradle lift. In this aspect, each of the pair of mounting brackets attached to the swim platform includes a first plate 110 in the form of a long substantially linear leg which terminates in an angular flange 114, such as a 90° flange. Apertures are spaced along the linear leg 110 and receive fasteners, not shown, to secure the linear leg 110 to the swim platform in the same manner as the bracket 80 shown in FIG. 7.

The shorter outer leg 114 is fixed by one or more fasteners 116 to an intermediate portion of a multi-angular bent second bracket 120. The second bracket 120 includes a first end flange 122 fixed by fastener 124 to the leg 112. An angular leg 126 extends from the first end flange 122 and terminates in an upper generally horizontally extending leg 128. A vertical leg 130 extends from an outer end of the upper leg 128 to a lower leg 132 which is substantially parallel to the upper leg 128. The lower leg 132 projects inward toward the swim platform 10 and transitions into a short vertical leg 136 which ends in an end flange 138 fixed by a fastener 140 to the leg 112.

A pair of U-shaped mounting arms, including an upper arm assembly 140 and a lower arm assembly 142, is fixed at an intermediate or central leg portion to the vertical leg 130 of each second bracket 120. The upper and lower arm assemblies 140 and 142 are spaced apart and have braces 144 on each arm of each upper and lower arm assemblies 140 and 142 extending angularly from outer ends of each arm of the upper and lower arm assemblies 140 and 142. The braces 144 may be welded to the upper and lower arm assemblies 140 and 142 and carry apertures aligned with the apertures 146 and 148 in the upper and lower arm assemblies 140 and 142, respectively, for receiving the lock pins 50 and 52.

FIGS. 9-13 depict another aspect of a davit cradle lift 150. The cradle assembly for the davit cradle lift 150 is substantially the same as the cradle assembly 60 shown in FIG. 1.

Figure 10:
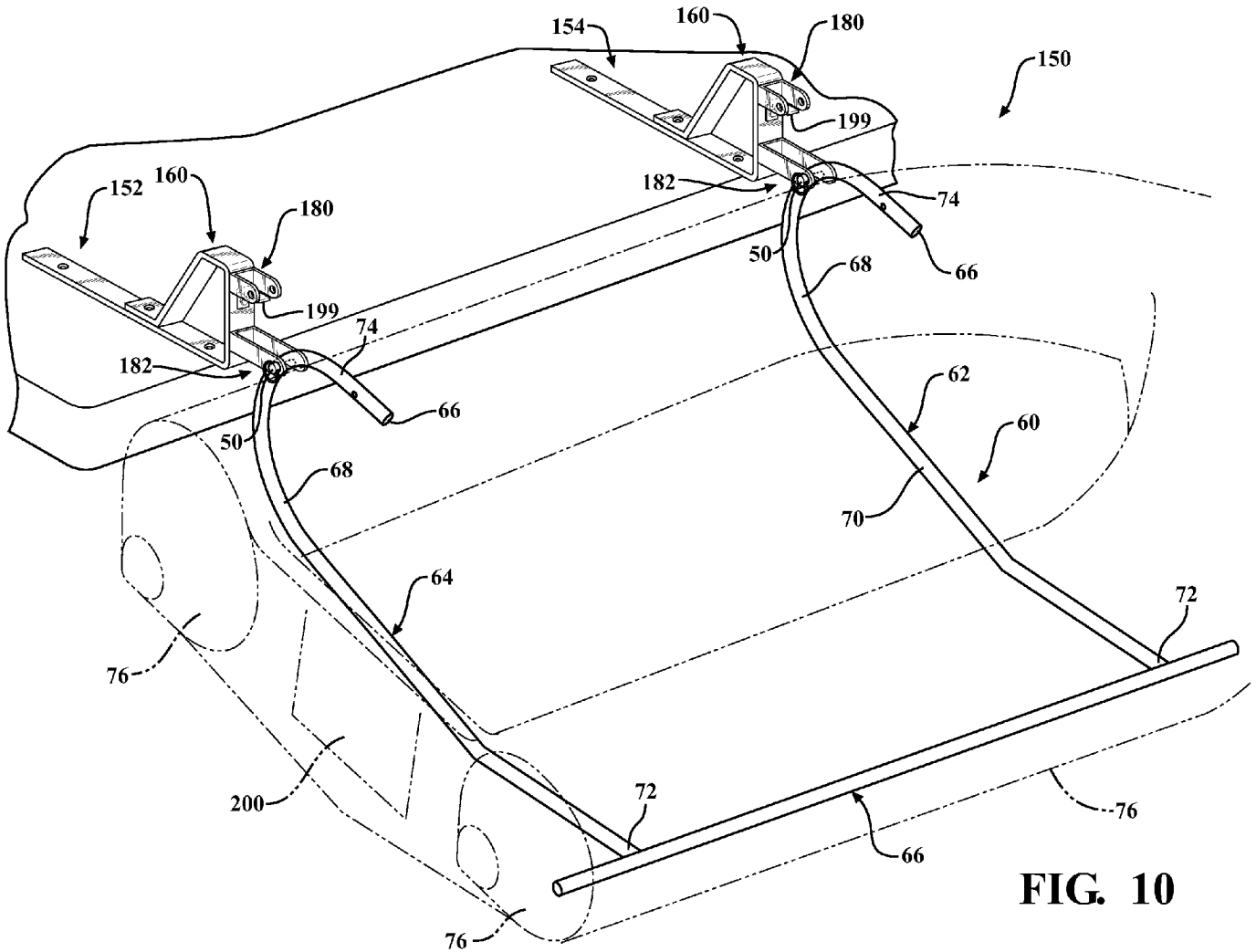
FIG. 10 is a perspective view showing a pair of mounts, one of which is depicted in FIG. 9, mounted on a boat and supporting the davit cradle in a deployed position.
Figure 12:
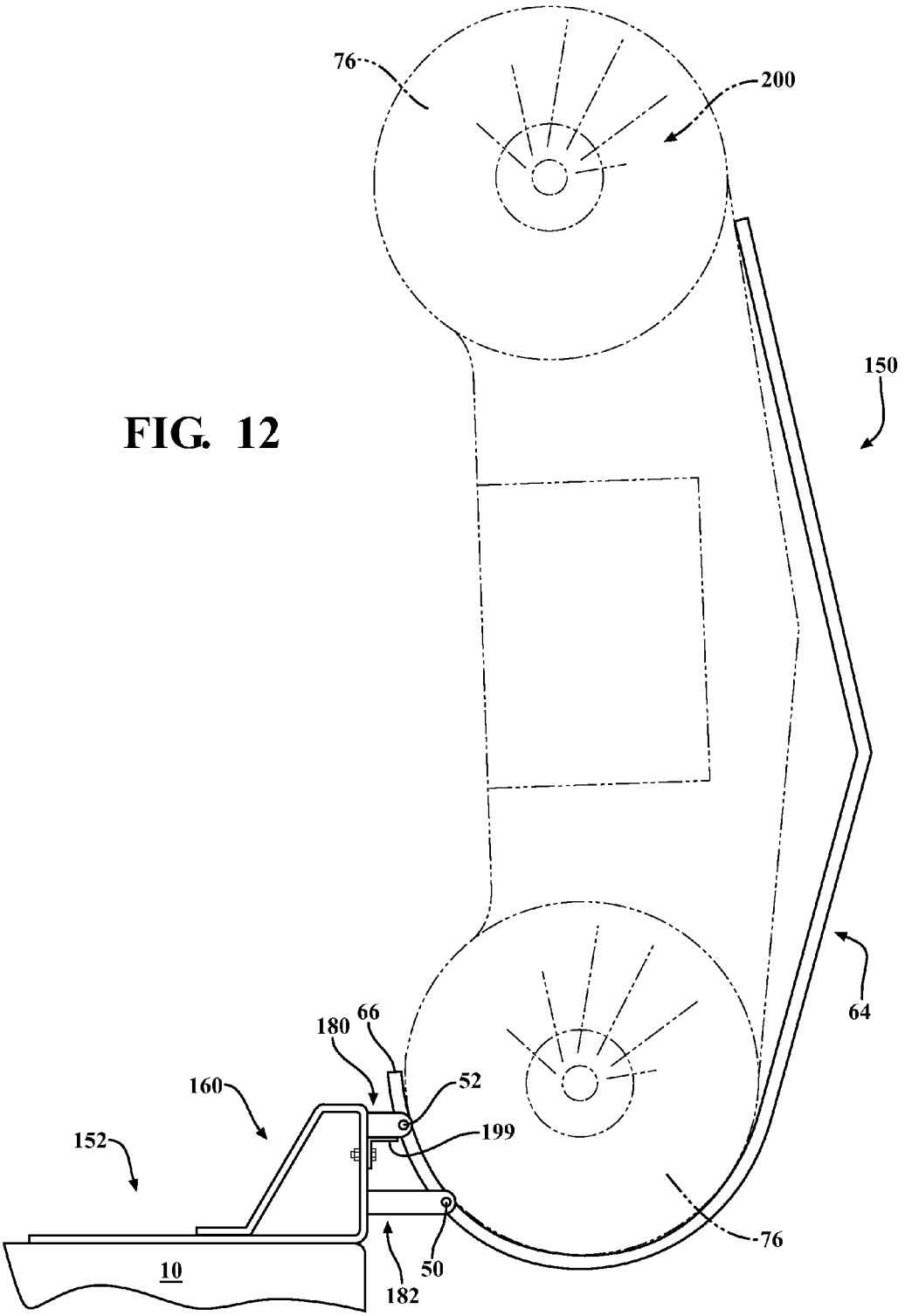
FIG. 12 is a side elevational view showing the davit cradle lift of FIGS. 9-11 in a vertical storage position.
Figure 13:
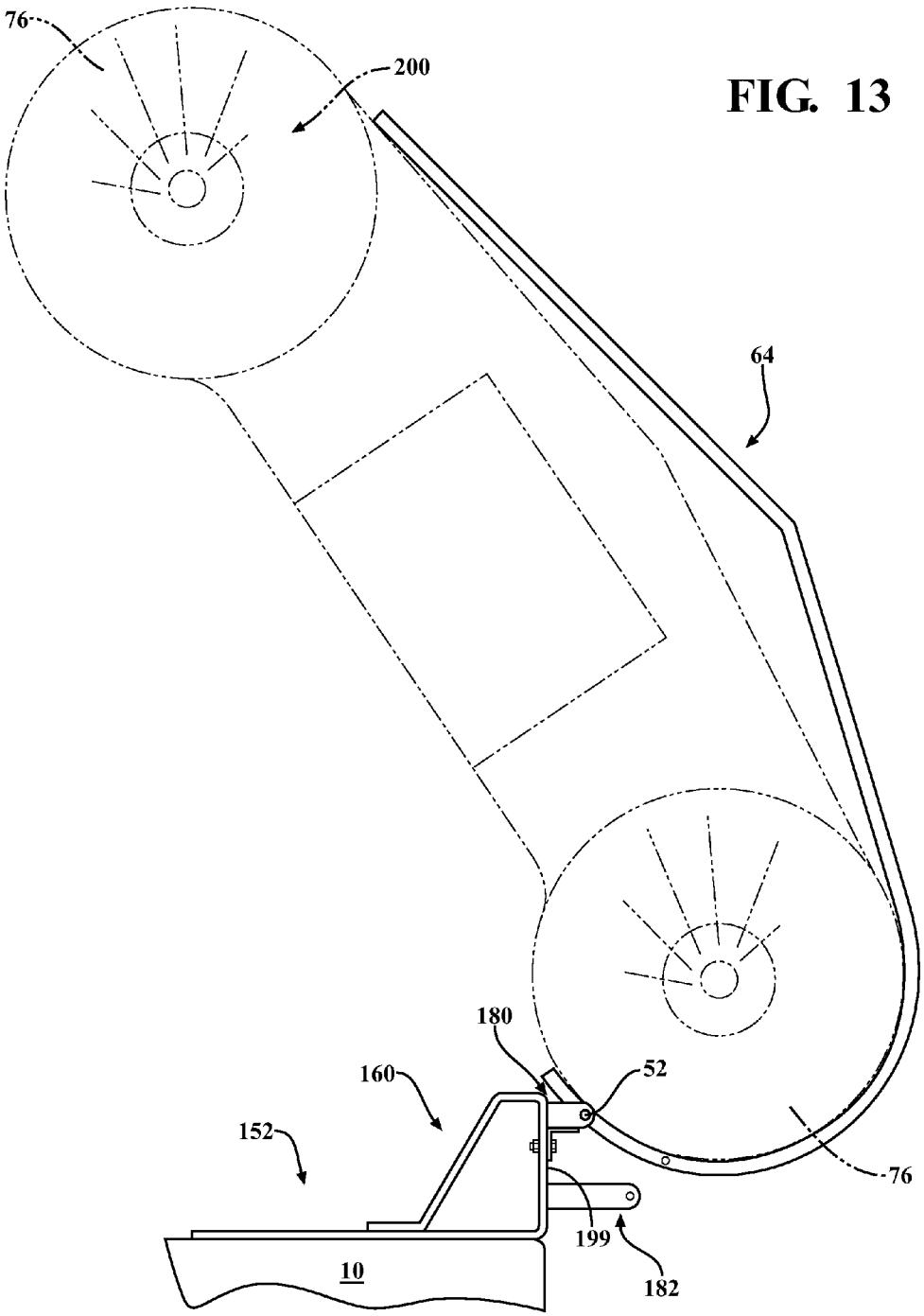
FIG. 13 is a side elevational view showing the davit cradle lift of FIGS. 9-11 in a forward inclined, transport position.

In this aspect, however, a pair of mounting brackets 152 and 154, substantially identically constructed, are mounted on the swim platform 10 and are removably coupled by the lock pins 50 and 52 to the cradle assembly 60 to enable the cradle assembly 60 to be moved between the deployed position shown in FIG. 10 for loading and unloading a small boat to and from the cradle assembly 60, to a substantially vertical position shown in FIG. 12, or to a forward inclined transport position shown in FIG. 13.

Each mounting bracket 152 and 154 includes a single multi-section bent plate 160; although separate pieces can be welded or secured together to form the one piece plate 160. The plate 160 includes apertures 162 for attachment by fasteners to the swim platform 10. The plate 160 includes a first long linear leg 166 which transitions in a substantially 90° bend to a vertically extending outer leg 168. The outer leg 168 transitions to an angular, such as a 90° bent, upper leg 170 to an angular leg 172 which terminates in an end flange 174 having an aperture for receiving a fastener for securing the end flange 174 to the first leg 166.

An upper arm assembly 180 and a lower arm assembly 182 are fixed by fasteners to the vertical leg 168 of the mounting bracket 152 or 154. The upper arm assembly 180 is formed of first and second spaced side arms 184 and 186 which extend generally angularly or perpendicularly from a central leg 188 which receives the fastener for attaching the upper arm assembly 180 to the mounting bracket 160.

The lower arm assembly 182 is similarly formed, but with longer length side arms 190 and 192 which extend angularly or perpendicularly from a central leg 194 which carries an aperture for receiving the fastener for attaching the lower arm assembly 182 to the vertical leg 168 of the mounting bracket 160.

Apertures 194 are formed in each of the side arms 184 and 186, and 190 and 192 of the upper and lower arm assemblies 180 and 182 for receiving the lock pins 50 and 52.

A stop 199, in the form of an angle strap shown in FIGS. 10-15, is mounted on vertical leg 168 of the mounting brackets 152 and 154. The outer surface of the stop 199 provides a rest surface for mounting the longitudinal cradle members 62 and 64 of the cradle assembly 60 in the mounting brackets 152 and 154. An end portion of the tubular members 62 and 64 can be brought into engagement with the stop member 199 to assist in aligning the apertures in the mounting brackets 152 and 154 with the apertures in the tubular members 62 and 64.

The davit cradle lift 150 operates in the same manner as the davit cradle lift shown in FIG. 1. With the upper lock pin 52 removed from the apertures in the end of the longitudinal tubular members of the cradle assembly 60 and the upper arm assemblies 180, the cradle assembly 60, can be lowered to a deployed position shown in FIG. 10 for off-loading or on-loading a small boat 200 onto the cradle assembly tubular members.

Next, manually or by a winch, such as the winch 81 shown in FIGS. 3 and 4, the davit cradle lift 150 can be raised to a substantially vertical position shown in FIG. 12 for storage of the small boat. In this position, the lock pin 52 is reinserted to the apertures in the upper arm assemblies 180 of both mounting brackets 152 and 154 and the apertures in the end legs of the tubular members of the cradle assembly 60 to lock the cradle assembly in the raised vertical storage position. Next, prior to movement of the large boat carrying the small boat 200, the lower lock pins 50 in the lower arm assemblies 182 may be removed to enable the cradle assembly 60 to be pivoted forward to an angular inclined position shown in FIG. 13 for more streamlined positioning of the small boat 200 during the movement of the large boat.

Figure 14:
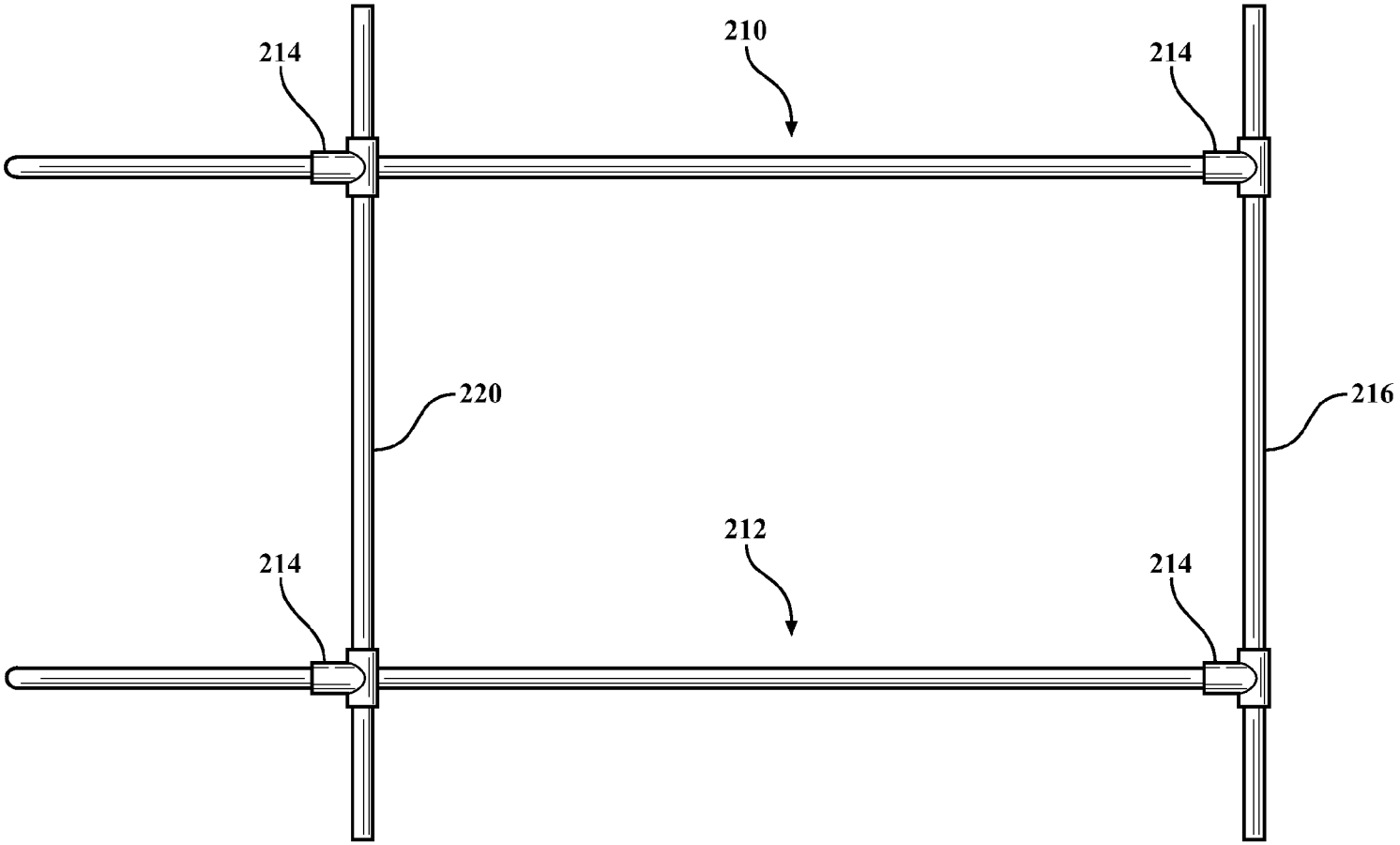
FIG. 14 is a plan view of another aspect of a davit cradle lift.

FIG. 14 depicts another aspect of the cradle assembly in which the first and second tubular members 210 and 212, which have the V-shape, and the curved end portions shown in FIG. 1 are provided with tee connectors 214 which have a threaded set screw for locked or fixed engagement of the outer ends of the tubular members 210 and 212 to the third laterally extending cross tubular member 216 extending through two tee connectors 214. Similarly, the ends of the tubular members 210 and 212 adjacent to curved end portions of the tubular members 210 and 212 also receive tee connectors 214 for securing to a fourth laterally extending crosswise tubular member 220. This four-sided arrangement for the cradle assembly 60 provides a rigid structure for supporting larger size or heavier small boats.

Figure 15:
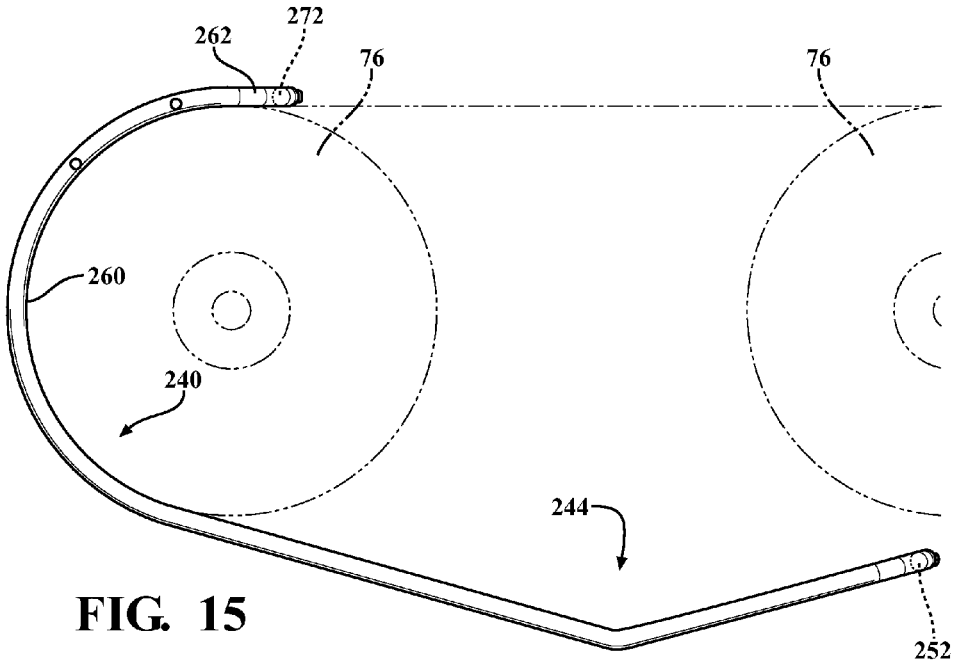
FIG. 15 is a side elevational view of another aspect of a cross arm for one of the davit cradle lifts shown in FIGS. 1-13.
Figure 16:
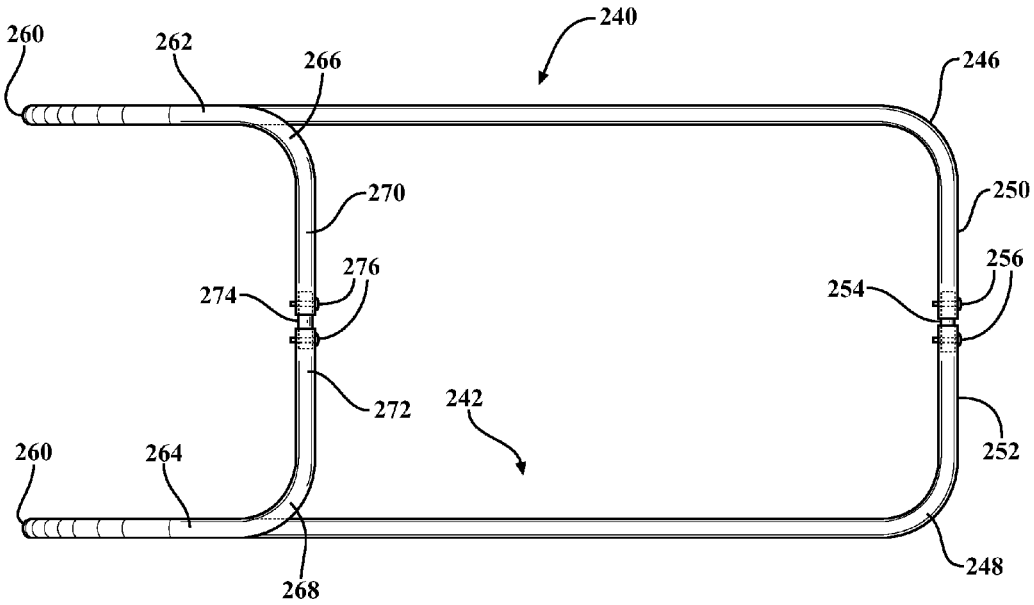
FIG. 16 is a plan elevational view showing another aspect of the cross arms of a davit cradle lift, one of which is depicted in FIG. 15.

Referring now to FIGS. 15 and 16, there is depicted another aspect of a cradle assembly in which the first and second tubular members 240 and 242 each have a V-shaped center section 244 for supporting the hull of a small boat, as with the other aspects of the cradle assemblies described herein. One end portion of each of the first and second tubular members 240 and 242 extends through an angular or 90° bend 246 and 248, respectively, to short length outer ends 250 and 252. The ends 250 and 252 receive an internally disposed tubular collar 254 which can be secured to the ends 250 and 252 by fasteners 256.

The opposite ends of the first and second tubular members 240 and 244 have the concave curved section 260 which terminates in a short length linear end portion 262 for the tubular member 240 and a short length end section 264 for the second tubular member 244. Each short length end section 262 and 264 transitions through an angular or 90° smoothly curved bend 266 and 268, respectively, into short length ends 270 and 272. An internally disposed collar 274 is locked in position between the spaced ends 270 and 272 and fixed in place by fasteners 276 extending to the ends of each end portions 270 and 272 to lock both of the tubular members 240 and 242 into a rigid unitary structure.

What is claimed is:

1. A davit cradle lift for boats with a rearwardly projecting horizontal surface comprising:

a cradle formed of two spaced longitudinally extending tubular members, each having first and second opposed ends, and a third laterally extending member connected adjacent the second ends of the first and second tubular members;

a pair of spaced apertures adjacent the first ends of each of the first and second tubular members;

a pair of mounting brackets, affixable to a horizontally extending rearward surface of a boat, the mounting brackets carrying first and second pairs of spaced apertures; and first and second pins respectively mountable the first and second aperture pairs, the first and second pins extending through one aperture of the first and second aperture pairs of each of the first and second tubular members, the first and second pins being removable and insertable at the same time, or only the second pin, or only the first pin, to allow the cradle to move between a lowered position where the cradle is disposed in the water to launch or retrieve a dinghy, and an out of water storage position.

2. The davit lift of claim 1 wherein:

to achieve the launch and retrieval position, the first pin is removed from the apertures in the mounting bracket and the first ends of the first and second tubular members of the cradle.

3. The davit lift of claim 1 wherein:

the out of water storage position is secured by inserting both of the first and second pins into the aligned pairs of apertures in the pair of mounting brackets and the apertures in the first ends of the first and second tubular members of the cradle after the cradle has been pivoted to an upright position.

4. The davit lift of claim 1 wherein:

a forward angled storage position is achieved by removing the second pin from the aligned apertures in the mounting bracket and the first and second longitudinally extending members of the cradle to allow the cradle to pivot about the first pin in the pair of apertures in the mounting brackets and one aperture in the first end of the first and second longitudinally extending members.

5. The davit lift of claim 1 wherein the pair of mounting brackets comprise:

a first leg portion mountable to a rearward extending horizontal surface of a boat, and a vertically extending portion;

upper and lower pairs of arms fixedly coupled to the vertical portion of each mounting bracket; and apertures formed in the upper and lower pairs of arms for receiving the first and second pins.

6. The davit lift of claim 5 further comprising:

a stop member mounted on the vertical portion of the bracket, the stop member providing the reference surface for aligning the apertures in the longitudinally extending members of the cradle and the apertures in the upper and lower pairs of arms.

7. The davit lift of claim 5 wherein each mounting bracket comprises:

the first leg portion defining a linear leg portion;

the vertical portion extending from one end of the first leg portion; and an angled section extending from an end of the vertical portion to a fixed connection with the first leg portion.

8. The davit lift of claim 1 further comprising:

a fourth laterally extending member adjacent the first ends of the first and second tubular members.

9. The davit lift of claim 1 wherein each of the first and second tubular members comprise:

a first leg portion extending from a curved portion adjacent the first end and extending toward the opposite longitudinally extending first and second tubular member;

a second leg portion extending from the second end of each longitudinally extending tubular member, the second end portion spaced from an opposed end of the opposed first and second tubular members; and connectors fixedly coupling ends of the first and second leg portions of each of the first and second tubular members into a unitary structure.

10. The davit lift of claim 5 further comprising:

the upper arm pairs extending a first distance from a vertical leg of the bracket; and the lower arm pairs extending a second distance from the vertical leg of the bracket, the second distance being greater than the first distance.

11. The davit lift of claim 1 further comprising:

upper and lower arm pairs integral with a vertical leg.

12. The davit lift of claim 1 further comprising:

a vertical leg of the mounting bracket extending above a horizontal surface of a boat on which a linear leg is mounted.

13. A davit cradle lift for boats with a rearwardly projecting horizontal surface comprising:

a cradle formed of two spaced longitudinally extending members, each having first and second opposed ends, and a third laterally extending member connected adjacent the second ends of the first and second longitudinally extending members;

two spaced apertures formed in an arcuate section extending from a linear end portion of the first ends of each of the first and second tubular members;

a pair of mounting brackets, affixable to a horizontally extending rearward surface of a boat, the mounting brackets carrying first and second pairs of spaced apertures and a leg portion mountable to a rearward extending horizontal surface of a boat, and a vertically extending portion, the vertical extending portion extending above the rearward horizontal surface of the boat on which the first leg portion is mounted;

upper and lower pairs of arms fixedly coupled to the vertical extending portion of each mounting bracket;

the first and second pairs of apertures disposed in the upper and lower pairs of arms for receiving the first and second pins;

the upper arm pairs extending a first distance from the vertical extending portion of the mounting brackets, upper the lower arm pairs extending a second distance greater than the first distance from the vertical extending portions of the mounting brackets; and first and second pins respectively mountable in an upper most pair and a lower most pair of the first and second aperture pairs, the first and second pins extending through one aperture of the first and second pairs of aperture in the first ends of each of the first and second tubular members, the first and second pins being removable and insertable both at the same time, or only the second pin, or only the first pin, to allow the cradle to move between a lowered position where the cradle is disposed in the water to launch or retrieve a dinghy, and a generally upright storage position.

* * * * *